US008579740B2

(12) United States Patent
Kessler

(10) Patent No.: US 8,579,740 B2
(45) **Date of Patent: *Nov. 12, 2013**

(54) BOUNCING BALL AMUSEMENT DEVICE HAVING REDUCED TRANSPARENCY

(71) Applicant: Maui Toys, Inc., Los Angeles, CA (US)

(72) Inventor: Brian Kessler, Los Angeles, CA (US)

(73) Assignee: Maui Toys, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/764,452

(22) Filed: Feb. 11, 2013

(65) Prior Publication Data

US 2013/0157791 A1 Jun. 20, 2013

Related U.S. Application Data

(63) Continuation of application No. 12/464,667, filed on May 12, 2009, now Pat. No. 8,371,970, which is a continuation-in-part of application No. 12/357,920, filed on Jan. 22, 2009, now abandoned.

(51) Int. Cl.
*A63B 43/00* (2006.01)
*A63B 43/06* (2006.01)

(52) U.S. Cl.
USPC ..... 473/594; 473/570; 473/596

(58) Field of Classification Search
USPC ..... 473/594, 603–607, 570, 596
See application file for complete search history.

(56) References Cited

U.S. PATENT DOCUMENTS

| | | | | |
|---|---|---|---|---|
| 3,119,621 | A | 1/1964 | Bookman | |
| 3,168,315 | A | 2/1965 | Bookman | |
| 3,731,928 | A | 5/1973 | Wolfe | |
| 3,980,300 | A | 9/1976 | Hornsby, Jr. | |
| 4,049,277 | A | 9/1977 | Carlsson, Jr. et al. | |
| 4,872,676 | A | 10/1989 | Townsend | |
| 5,066,011 | A | 11/1991 | Dykstra et al. | |
| 5,320,345 | A | 6/1994 | Lai et al. | |
| 5,406,728 | A | 4/1995 | Willitts, Jr. | |
| 5,516,098 | A | 5/1996 | Aiello | |
| 5,722,906 | A | 3/1998 | Gentile | |
| 5,749,799 | A | 5/1998 | Jasperson | |
| 5,924,942 | A | 7/1999 | Gentile | |
| 6,368,176 | B1 | 4/2002 | Lozowski et al. | |
| 6,416,430 | B2 | 7/2002 | Moore | |
| 6,464,602 | B1 | 10/2002 | Rottger | |
| 6,755,416 | B2 | 6/2004 | Nakamoto et al. | |
| 8,371,970 | B2 * | 2/2013 | Kessler | 473/594 |
| 2003/0171173 | A1 | 9/2003 | Rudzki | |
| 2005/0143204 | A1 | 6/2005 | Lin | |
| 2007/0072712 | A1 | 3/2007 | Chernick et al. | |
| 2008/0305899 | A1 | 12/2008 | Lin | |
| 2010/0261561 | A1 | 10/2010 | Wang | |

* cited by examiner

*Primary Examiner* — Steven Wong
(74) *Attorney, Agent, or Firm* — Browdy and Neimark, PLLC

(57) ABSTRACT

A ball amusement device including an outer shell of transparent or semi-transparent plastic or elastomer or plastomer having good bounce characteristics, and at least one liquid within the shell. The outer shell may be configured to reduce the transparency to light through the ball.

9 Claims, 6 Drawing Sheets

BOUNCING BALL AMUSEMENT DEVICE HAVING REDUCED TRANSPARENCY

CROSS-REFERENCE TO RELATED APPLICATIONS

The present application is a continuation of allowed U.S. patent application Ser. No. 12/464,667, filed May 12, 2009, now U.S. Pat. No. 8,371,970, which is the Continuation-in-Part of application Ser. No. 12/357,920, filed Jan. 22, 2009, now abandoned, the entire contents of each of which are hereby incorporated herein by reference.

FIELD OF THE INVENTION

The present invention relates to an amusement device in the form of a spherical ball having good bounce characteristics and having a reduced outer surface transparency and carrying therewithin decorative elements which give off decorative effects when the ball is in motion and/or other objects such as dies or light-up devices. The amusement device may be filled with water or in an alternative example embodiment with multiple liquids.

BACKGROUND

There are known today amusement devices comprising balls filled with water, some of which have glitter in the liquid. See e.g., co-pending application Ser. No. 12/300,626, filed on Nov. 12, 2008, the entirety of which is incorporated herein by reference, and Water Bouncer balls, made and sold by Maui Toys®. However, the known balls have a problem that arises if the ball is kept too long in the sunlight, because of their smooth surface and the water contained within the ball. The water in the ball acts as a magnifier of the light passing through the surface of the ball and the water, and heats the surface under the ball to an unacceptable level.

SUMMARY

It is an object of the present invention to solve the problem created by the smooth surface of the known balls, to reduce the magnifying effect.

It is another object of the present invention to provide an amusement device with decorative and amusing light effects.

While a device in accordance with the present invention may take various forms, a preferred form is in the shape of a ball, in which the wall or shell is made of a rubber or plastic or plastomer material having good bounce characteristics, and which is sufficiently transparent so that what is inside of the ball can be readily seen, the elements within the ball providing pleasing and changing decorative effects. A liquid such as distilled water or multiple liquids are within the ball. The surface of the ball is of reduced transparency so that light passing through the ball is disrupted and the magnifying effect of the water is reduced.

DETAILED DESCRIPTION

Figure 1A:
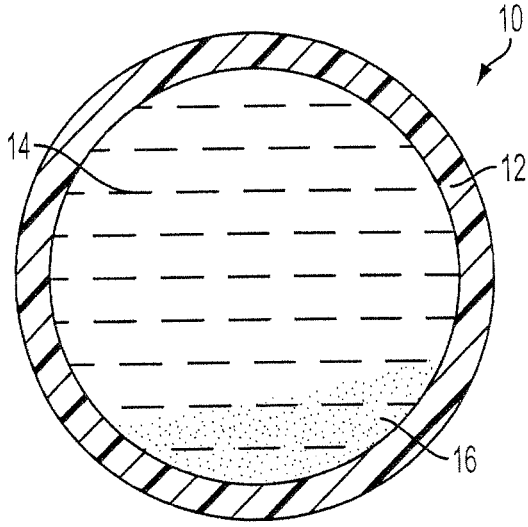
FIG. 1*a* is a partial sectional view of one example embodiment according to the present invention.

FIG. 1*a* shows a ball 10 in partial section having a wall 12 formed of a plastic or a rubber material which is both sufficiently transparent so that what is within the ball can be seen, and which has good bounce characteristics. The wall 12 may be in a spherical shape, or approximately spherical shape, or it can be egged shape, or any shape suitable for a toy of this kind.

A preferred material for forming the wall 12 is an methylene diphenyl diisocyanate based (MDI)-based polyurethane elastomer, but it will be understood that other materials which are sufficiently transparent and which have good bounce characteristics can also be used. For example, the composition of the polyurethane may include isocyanate, polyol, and/or a chain extender. The isocyanate may be a MDI type constituting 25 wt % of the polyurethane. The polyol may be a polyester and/or polyether type polyol with at least two functional OH groups on a molecular chain of the polyol, and the polyol may constitute 70 wt % of the polyurethane and have a molecular weight (MW) from 1000~10000 daltons. The chain extender may have at least two functional OH groups or at least two NH2 functional groups, it may constitute 5 wt % of the polyurethane, and it may have short chain molecules with MW50~800 daltons. As a result, the polyurethane may have a density of 1.1~1.2 g/cm$^3$, and a hardness of 70 A~90 A (A means hardness as measured by a shore A Durometer).

According to a first example embodiment illustrated in FIG. 1*a*, a liquid 14 is provided within the interior of the wall 12, and the liquid 14 preferably fills the interior of the ball 10 and is preferably injected under pressure. According to the first example embodiment, the liquid is preferably distilled water having a small amount of a child-safe anti-microbial agent such as anti-microbial soap included therein.

Also within the interior of the ball 10 there may be provided a plurality of small decorative and preferably reflective particles, e.g., so-called "glitter", well known to those skilled in the art. When the ball is shaken or thrown or bounced, the glitter 16 freely floats in the liquid 14 and its decorative effects can be seen through the wall 12 of the ball 10. The glitter is not essential, but is preferred, and any decorative particles of sufficiently small size, desirably made of non-toxic materials, can be used.

Since the ball 10 has a spherical surface, the ball 10 may have an effect on incident light like a focusing lens, i.e., the light that transmits through the ball 10 may be refracted and focused, causing a light magnifying or intensifying effect around the focus point. For example, it appears that this magnifying effect occurs in larger size balls, but not in smaller balls. This magnification or intensifying effect can cause problems, because as the ball intensifies the light, it can act as a magnifying glass in sunlight and thus can cause the surface underneath the ball to become overheated or extremely hot. The present invention relates to a way to reduce the magnifying or intensifying effect.

One way to accomplish this is to reduce the transparency of the ball 10. For example, the wall 14 may be modified to keep the ball 10 substantially transparent but also introduce something that breaks up the color light spectrum. This modification may be achieved by introducing to the wall 14 either a UV stabilizer, or a tint, or cloudiness, or as an alternative, roughening a surface finish of the ball 10.

With regard to the surface finish, a finer polish means a shiner and clearer skin on the ball 10. One approach to achieve the desired effect may be by adjusting the level of polish on the surface of a device (e.g., using a plastic mould) that is used to fabricate the ball to reach a predetermined roughened or textured level, so that the ball 10 made by the device may have a predetermined roughened or textured skin, i.e., the ball 10 may be less transparent because the surface of the ball 10 may create more disruption to the incident light. Since more light disruption means lower degree of focus to the light, the magnifying or intensifying effect is therefore reduced.

Figure 1B:
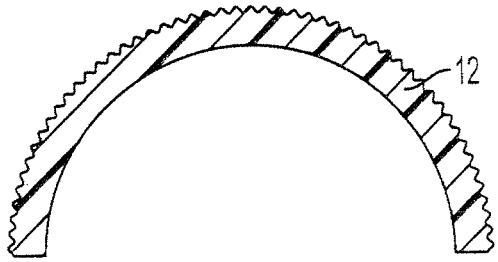
FIG. 1*b* is a magnified view of a rough surface of the example embodiment of FIG. 1*a*.
Figure 3:
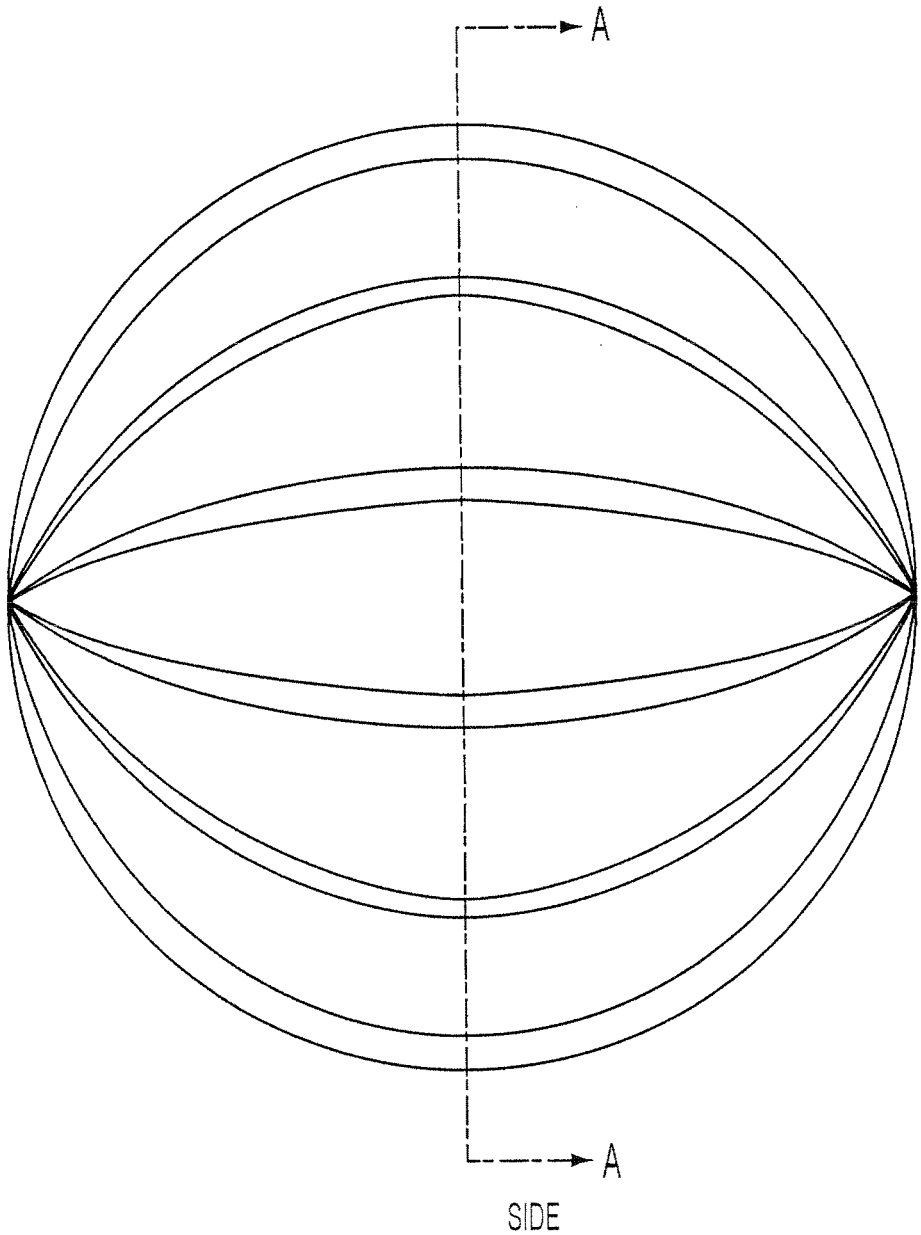
FIG. 3 is a partial sectional view of an example embodiment, depicting a fluted pattern on the surface of the device.
Figure 4:
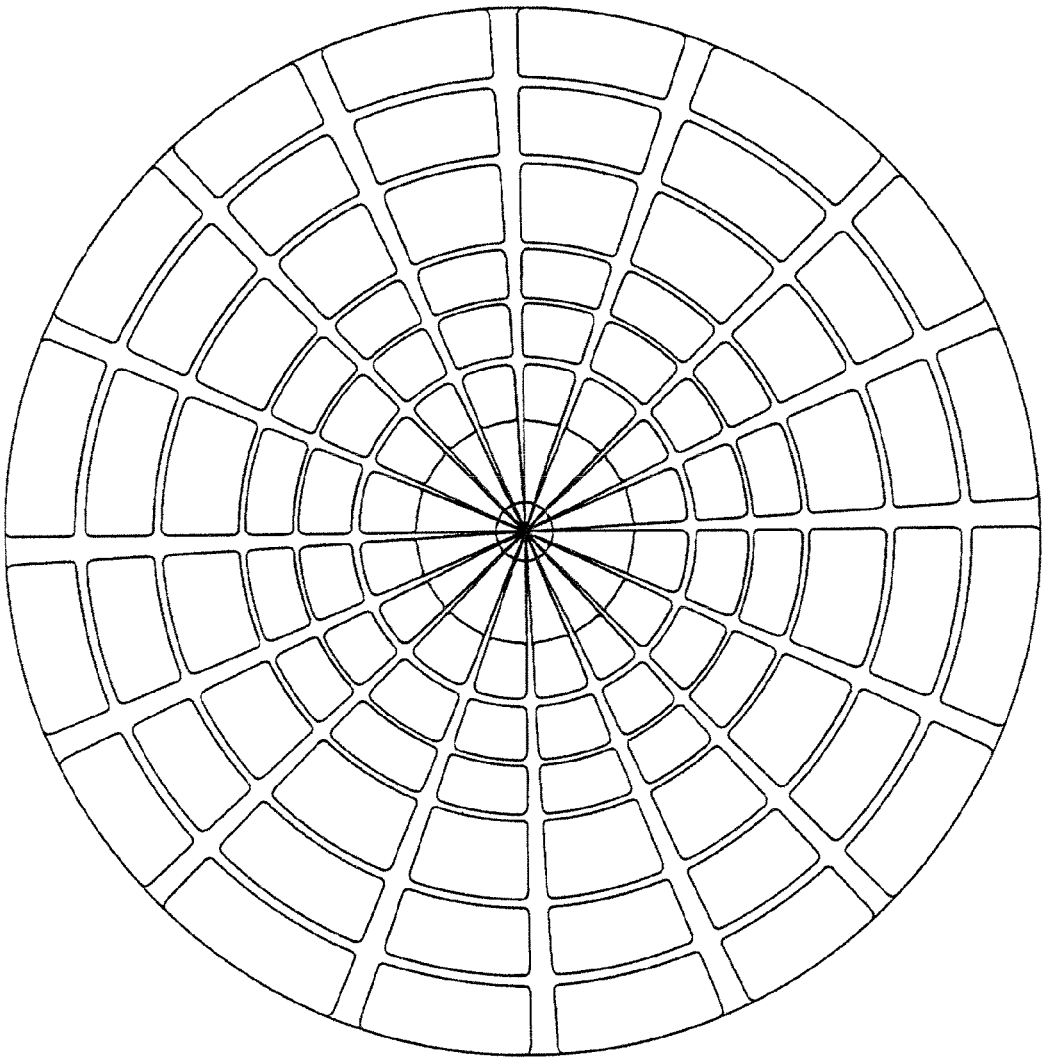
FIG. 4 is a partial sectional view of an example embodiment, depicting a cross-pattern, such as a spider web style pattern, on the surface of the device.
Figure 5:
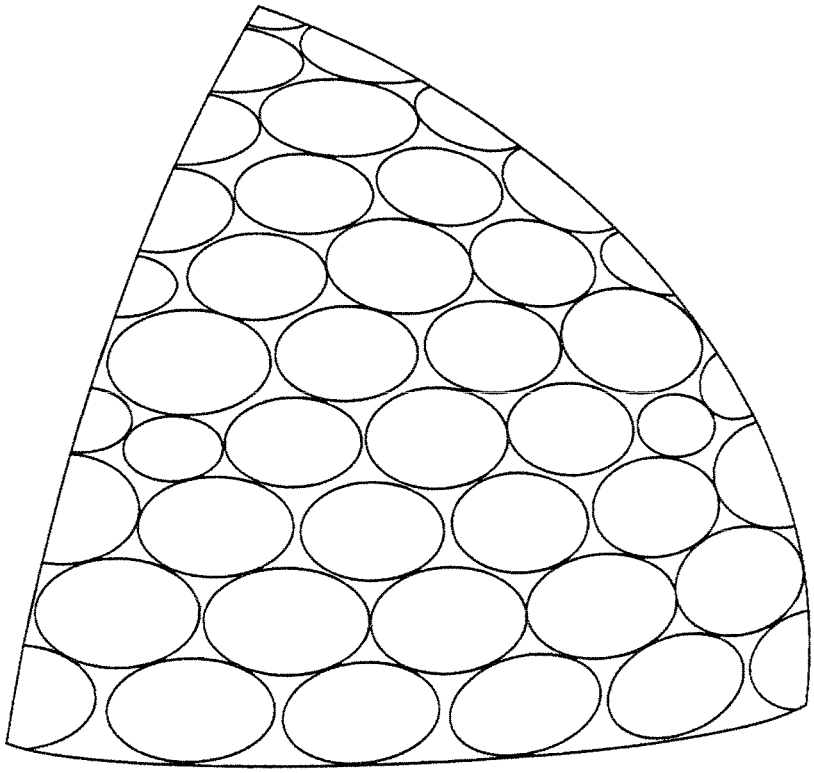
FIG. 5 is a partial sectional view of an example embodiment, depicting a golf ball dimple pattern on the surface of the device.
Figure 6:
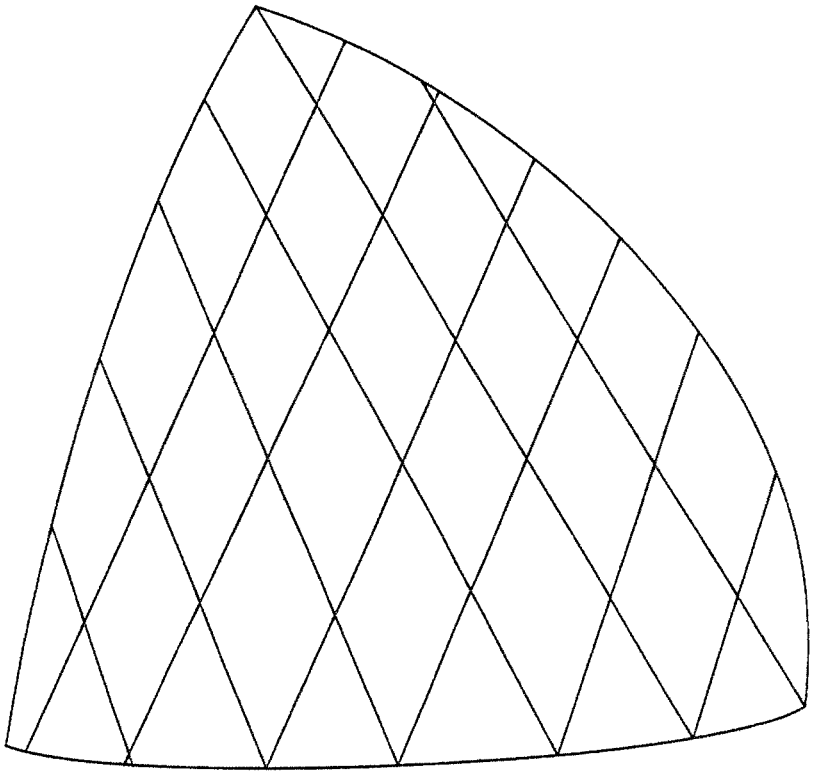
FIG. 6 is a partial sectional view of an example embodiment, depicting a diamond pattern on the surface of the device.

For example, in one embodiment, the roughened or textured skin may comprise small grooves, ridges, depressions, raised portions on the surface of the device, such as beads, bumps, bumpy ridges, dimples, or other shapes, and/or one or more combinations thereof, which may be randomly dispersed or arranged in patterns, and which may cover portions of the surface, or the entire surface of the device. A roughened surface that is of the type that may be used according to this example embodiment is illustrated in a close-up view of FIG. 1*b*. In another embodiment, the roughened or textured skin may comprise one or more repeating patterns, and/or combinations thereof, including combinations with a roughened skin surface, which may cover portions of the surface, or the entire surface of the device. Examples of repeating patterns may include a fluted pattern as illustrated in FIG. 3, a crossing-pattern with overlapping lines, e.g., a spider web style pattern, as illustrated in FIG. 4, a golf-ball pattern with dimples as illustrated in FIG. 5, or a diamond pattern, as illustrated in FIG. 6. on the surface of the device.

In another embodiment, the amusement device may include a combination of both a roughened and textured skin (or multiple combinations) that may overlap each other and/or cover certain portions of the surface of device (for instance, one or more portions of the surface may have roughened skin, and one or more other portions may have textured skin), and the roughened and/or textured skin need not cover the entire surface of the device.

Figure 2A:
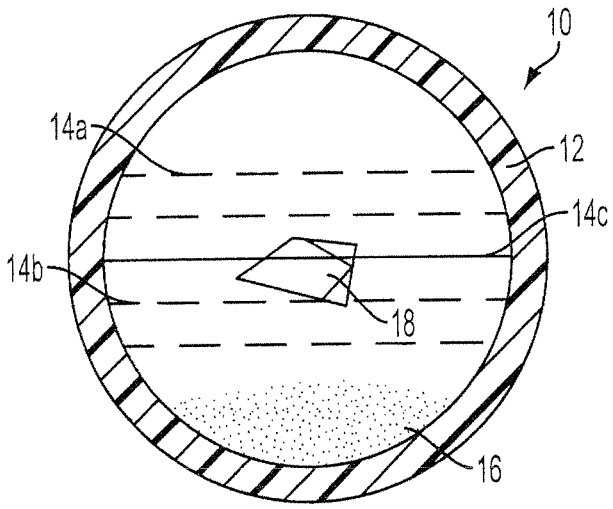
FIG. 2*a* is a partial sectional view of a second example embodiment, showing that a first liquid and a second liquid are separated by a horizontal plane when the first and second liquids are in a state of rest.
Figure 2B:
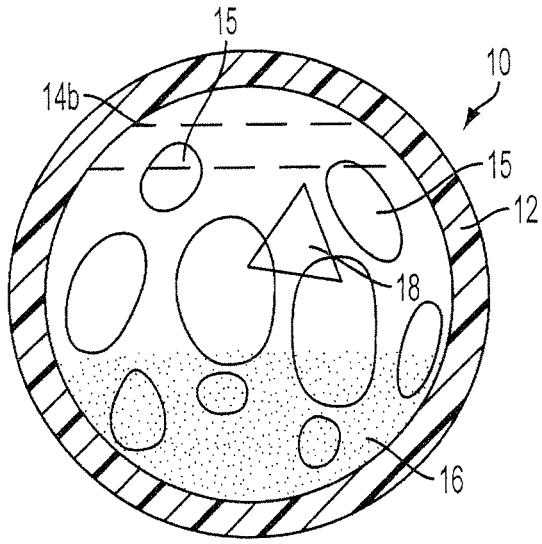
FIG. 2*b* is a partial sectional view of the second example embodiment, showing that the first liquid and second liquids are inter-mixed together to form bubbles and puddles when the first and second liquids are shaken.

According to another example embodiment, multiple immiscible liquids may also be provided within the interior of the ball 10. For example, FIGS. 2*a* and 2*b* illustrate a second example embodiment of the present application that two immiscible liquids are provided within the ball 10. The surface finish of the ball 10 in this example embodiment may be smooth, or it may be of the type that has a reduced transparency, as described above.

According to FIG. 2*a*, a first liquid 14*a* and a second liquid 14*b* may be provided within the interior of the wall 12. For example, the liquids 14*a* and 14*b* may be injected into the ball 10 under pressure. The first and second liquids 14*a* and 14*b* may be immiscible with respect to each other, and the second liquid 14*b* may have a higher density than that of the first liquid 14*a*. For example, the first liquid may be oil or a gel and the second liquid may be distilled water having a small amount of a child-safe anti-microbial agent such as anti-microbial soap included therein. Further, the first liquid 14*a* may be dyed to a first color and the second liquid may be dyed to a second color. For example, the first liquid 14*a* may be clear without any color and the second liquid 14*b* may be dyed blue or some other color. As a result, when the first and second liquids 14*a* and 14*b* come to a state of rest, a horizontal plane 14*c* is created between the first and second liquid 14*a* and 14*b*, distinguishable by the color difference between the two liquids, as shown in FIG. 2*a*. As shown in FIG. 2*b*, when the ball 10 is shaken up, the first liquid 14*a* inter-mixes the second liquid 14*b* temporarily, creating bubbles and colored puddles 15 within the ball. When the ball 10 is kept from disturbance for a period of time, the second liquid 14*b*, because of the higher density and being immiscible to the first liquid 14*a*, gradually settles to a lower portion of the ball 10, and the horizontal plane 14*c* in FIG. 2*a* is again visibly resumed.

It should also be understood that the number of liquids injected in the ball 20 may not be limited to one or two. Multiple immiscible liquids more than two may also be provided within the interior of the wall 12, and each liquid may have a density and a color the same or different from any other liquids, so that there may be provided more than one color for the bubbles and puddles when the ball 10 is shaken and more than one horizontal planes may be formed between the liquids of different densities when the ball 10 come to a state of rest.

As an option, other objects may also be included inside of the ball. For example, as illustrated in FIGS. 2*a* and 2*b*, a buoyant device 18 as in the parent co-pending U.S. patent application Ser. No. 12/357,920, the entirety of which is incorporated by reference herein, and/or a light-up device (not shown) such as that disclosed in the co-pending U.S. patent application Ser. No. 12/300,626, the entirety of which is incorporated herein by reference, may also be provided within the interior of the ball 10, so that the buoyant and/or the light-up device either float, remain suspension, or sink in the liquids.

Accordingly, as another option, the glitter particles 16 described above with respect to the first example embodiment of FIG. 1*a* may also be included in the second example embodiment.

The amusement device is used simply by bouncing it or throwing it against any hard object such as a wall. When it hits a wall or a floor or the ground light will reflect off the glitter 16 and enhance the visual effect which will be seen through the semi-transparent wall 12. The particles 16 may be of a single color or of different colors, and may be reflective or non-reflective.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A ball amusement device comprising:

an outer shell of transparent or semi-transparent elastomeric polyurethane having good bounce characteristics;

wherein the elastomeric polyurethane of the outer shell is an MDI-based polyurethane;

water within and filling the shell, wherein the ball amusement device has good bounce characteristics;

wherein the transparent or semi-transparent outer shell is configured with a roughened or textured surface to reduce the transparency to light through the ball;

wherein the composition of the polyurethane elastomer includes at least one of isocyanate, polyol, and a chain extender; and wherein the isocyanate is a methylene diphenyl diisocyanate as part of the polyurethane elastomer, the polyol is at least one of a polyester and a polyether-type polyol with at least two functional OH groups on a molecular chain of the polyol with a molecular weight of 1,000-10,000, and the polyurethane elastomer has a density of 1.1-1.2 g/cm$^3$ and a hardness of 70 A-90 A.

2. The amusement device of claim 1 further comprising glitter particles inside of the shell.

3. The amusement device of claim 1, wherein the textured surface of the outer shell comprises a UV stabilizer or tint.

4. The amusement device of claim 1, wherein the textured surface of the outer shell is capable of and selected to break up color light spectrum that could otherwise cause a magnifying effect that could make the ball amusement device intensify light and act like a magnifying glass in sunlight.

5. The amusement device of claim 1, wherein the outer shell is a spherical shape or an egg shape.

6. The amusement device of claim 1, further comprising an element within the outer shell, wherein the element is one of a buoyant and light-up device.

7. The amusement device of claim 1, wherein the outer shell with a roughened or textured surface comprises one or more selected from the group consisting of grooves, ridges, depressions, raised portions, beads, bumps, dimples, one or more repeating patterns, and combinations thereof, which may be randomly dispersed or arranged in patterns, and which may cover portions of the surface, or the entire surface of the ball amusement device.

8. The amusement device of claim 7, wherein the one or more repeating patterns are selected from the group consisting of a fluted pattern, a crossing-pattern with overlapping lines, a spider web pattern, a golf-ball pattern, and a diamond pattern.

9. The amusement device of claim 7, wherein the outer shell surface comprises raised portions or bumps which cover only portions of the surface.

* * * * *